United States Patent [19]

Rapaway

[11] Patent Number: 4,891,907

[45] Date of Patent: Jan. 9, 1990

[54] SECURITY LOCK AND SEAL FOR DOUBLE DOOR OR WINDOW INSTALLATIONS

[76] Inventor: Mychail Rapaway, Box 37, Group 607, S.S. #6, Winnipeg, Manitoba, Canada, R2C 2Z3

[21] Appl. No.: 241,492

[22] Filed: Sep. 8, 1988

Related U.S. Application Data

[63] Continuation-in-part of Ser. No. 108,897, Oct. 14, 1987, abandoned.

[30] Foreign Application Priority Data

Oct. 23, 1986 [CA] Canada ..... 521265

[51] Int. Cl.[4] ..... E05B 65/04

[52] U.S. Cl. ..... 49/67; 292/59; 292/336.3; 292/347; 292/358

[58] Field of Search ..... 49/67, 62, 63; 292/358, 292/347, 336.5, DIG. 30, 57, 59, 336.3; 403/254, 255

[56] References Cited

U.S. PATENT DOCUMENTS

| | | | |
|---|---|---|---|
| 525,906 | 9/1894 | Johnson . | |
| 1,102,519 | 7/1914 | Lande | 292/57 |
| 1,382,758 | 6/1921 | Brown . | |
| 1,480,686 | 1/1924 | Light . | |
| 1,622,791 | 3/1927 | Lang | 292/57 X |
| 1,639,661 | 7/1927 | Newcomb . | |
| 1,664,820 | 4/1928 | Hughes . | |
| 1,842,724 | 1/1932 | Langsner . | |
| 2,018,346 | 10/1935 | Busby . | |
| 2,537,896 | 9/1951 | Hinton et al. . | |
| 4,302,907 | 12/1981 | Canals et al. . | |
| 4,660,873 | 4/1987 | Sholund . | |
| 4,688,835 | 8/1987 | Wu | 292/59 |

FOREIGN PATENT DOCUMENTS

| | | | |
|---|---|---|---|
| WO85/04443 | 10/1985 | PCT Int'l Appl. | 292/57 |

*Primary Examiner*—James R. Brittain

*Attorney, Agent, or Firm*—Stanley G. Ade; Murray E. Thrift; Adrian D. Battison

[57] ABSTRACT

The present device secures two doors or panels together from the inside, either separately from or integral with a lock assembly for the outer door. A moveable element is provided on the inner surface of the outer door selectively engageable by a rotatable link on the inner door which may be engaged with the outer door element when both doors are closed.

13 Claims, 4 Drawing Sheets

SECURITY LOCK AND SEAL FOR DOUBLE DOOR OR WINDOW INSTALLATIONS

This application is a continuation-in-part of application Ser. No. 108,897 filed Oct. 14, 1987, abandoned.

BACKGROUND OF THE INVENTION

This invention relates to new and useful improvements in security lock and/or sealing assemblies for double door installations, although it is readily adaptable for use with casement type windows.

Conventionally, the main door of a dwelling is of a relatively heavy construction and includes a sliding latch lock assembly and/or a dead bolt assembly and provides the major security of the entrance. The second or outer door usually acts as a storm door and often is not of such heavy construction and often includes a relatively flimsy lock assembly which is easily forced. Even when a stronger outside door assembly is utilized, there is no cooperation between the two doors to foil break-in attempts.

It is conventional, with such double door installations to have the outer door opening outwardly and the inner door opening inwardly from a common frame assembly and the present invention adds considerably to the security of the double door assembly regardless of the type of lock sets or dead bolts which are utilized on either of the doors.

It should be stressed that the present invention is primarily to ensure greater safety when the occupants are inside the house and not when they are absent therefrom as the device is preferably only operable from the inside of the dwelling. However, if desired, it is readily adaptable for exterior operation by incorporation of an exterior lock and key or by remote control.

PRIOR ART

U.S. Pat. No. 525,906, I. Johnson, Sept. 11, 1894, this shows a latching device for double doors which includes a gear on each door knob which engage with one another when the doors are latched and enables them to be opened concurrently without unlatching one from the other.

U.S. Pat. No. 1,382,758, M. A. Brown, June 28, 1921, this shows a sash fastener for sliding window sashes and includes a screw-threaded rod with a wedge end engaging through one and into the other sash frames.

U.S. Pat. No. 1,480,686, A. T. Light, Jan. 15, 1924, shows a screw-threaded securing device for holding two parts together.

U.S. Pat. No. 2,537,896, O. A. Hinton et al, Jan. 9, 1951, this shows a hardware unit for ventilating doors to detachably secure the inner door to the outer door.

U.S. Pat. No. 4,302,907, Canals et al, Dec. 1, 1981, this shows a personal security door arrangement which may be coupled together in the same frame opening by means of interrelated lock arrangements.

U.S. Pat. No. 1,639,661, A. D. Newcombe, Aug. 23, 1927, this shows a fastening device for sealed containers which includes a spring loaded bolt screw threadably engaged through one part of the container and into another.

U.S. Pat. No. 1,664,820, C. L. Hughes, Apr. 3, 1928, this shows a window fastener which includes a spring loaded bolt screw threadably engaging through the rail of one sash into the rail of a further sash.

U.S. Pat. No. 1,842,724, A. Langsner, Jan. 26, 1932, this shows a spring loaded clamping device for extension leveling rods.

U.S. Pat. No. 2,018,346, H. A. Busby, Oct. 22, 1935, this shows a window sash lock operating in a manner similar to U.S. Pat. No. 1,664,820 above.

U.S. Pat. No. 4,660,873, R. J. Sholund, Apr. 28, 1987, this discloses a screw-threaded bolt which is spring loaded and which engages through one door and detachably screw threadably engages the other door in order to selectively hold the two doors secured together.

SUMMARY OF THE INVENTION

One aspect of the invention includes a security lock assembly for double door installations which include an inner door and an outer door situated in spaced and parallel relationship within a door frame, when in the closed position; said assembly comprising in combination an element in the outer door adjacent the outer vertical edge thereof, a cooperating element in the inner door in engaging alignment with said element of said outer door when said doors are in the closed position, and means on the outer end of one of said elements for selectively and lockably engaging said element of said inner door with said element of said outer door thereby securing said doors together in a unitary relationship one with the other.

Another advantage of the present invention is that it may be formed integrally with the lock set of the outer door or, alternatively, may be installed as a separate locking device operable from the inside or outside of the dwelling.

A still further advantage of the invention is provide a device which adds additional security to the double door assembly yet which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
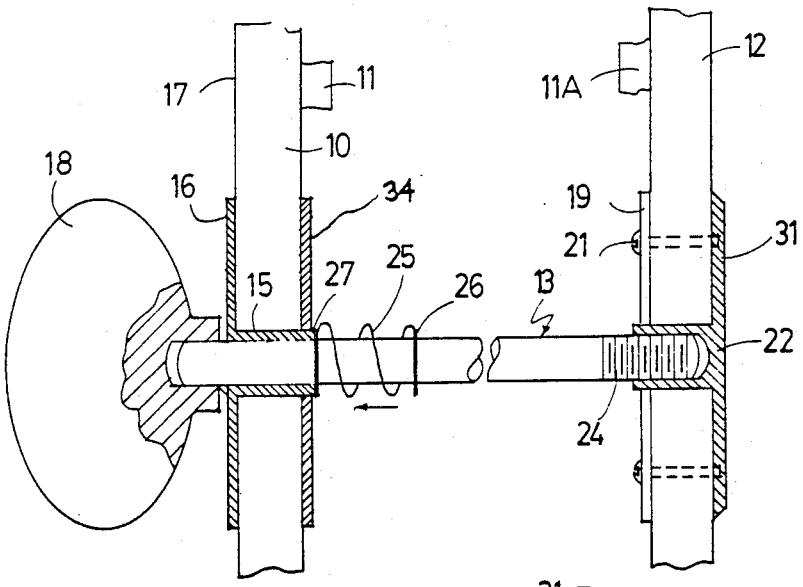
FIG. 1 is a fragmentary partially schematic vertical cross section of a pair of doors in the closed position, showing one embodiment of the invention in conjunction with a conventional lock set assembly.
Figure 2:
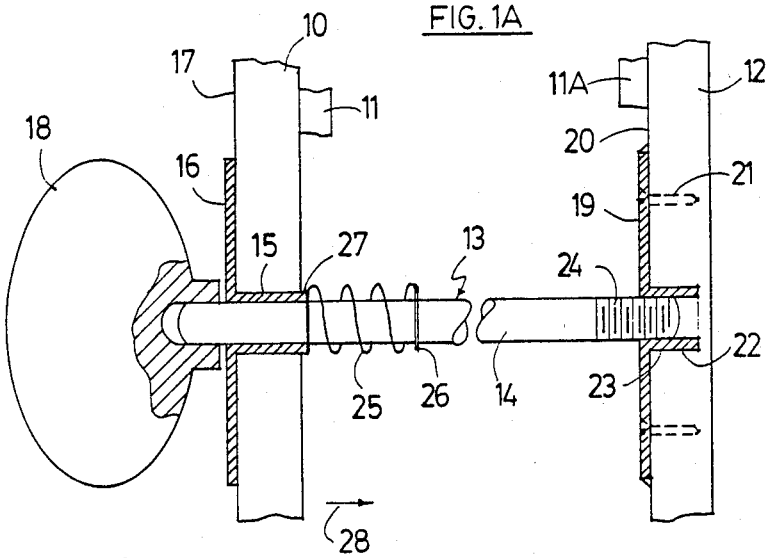
FIG. 2 is a view similar to FIG. 1 but showing the invention as a separate installation upon the double door assemblies.

Proceeding therefore to describe the invention in detail, reference should first be made to FIGS. 1 and 2 in which 10 illustrates a vertical section of an inner door in the closed position against stopping shown fragmentary at 11. Reference character 12 shows an outer door also in the closed position against stopping shown fragmentary by reference character 11A, it being understood that both doors are mounted in a common frame (not illustrated) and, when in the closed position, are in spaced and parallel relationship, one with the other.

FIG. 2 shows the simplest embodiment in which the invention collectively designated 13, consists of a bolt 14 freely rotatable within a sleeve 15 extending through the inner door adjacent the free vertical edge thereof (not illustrated) it being held in position by means of a plate 16 on the inner end thereof which may be secured to the inner surface 17 of the inner door 10 by means of screws or the like.

A door knob 18 or the like is secured to the inner end of the bolt 14 so that the bolt may be rotated freely within the sleeve 15.

This bolt 14 together with the knob 18 constitutes an element rotatably mounted within the inner door 10.

Reference character 19 illustrates a plate secured to the inner surface 20 of the outer door 12 by means of screws 21 or other fastening means, said plate 19 having an internally screw threaded sleeve 22 formed centrally thereof and extending upon one side as clearly shown. This engages within a blind bore 23 drilled into the outer door 12 adjacent the free vertical edge thereof (not illustrated).

The bolt 14 is provided with a screw threaded distal end 24 and is normally held retracted from contact with the sleeve 22, by means of a small tension spring 25 reacting between a pin 26 through the shank of the bolt 14 and the inner end 27 of the sleeve 15.

When the two doors are in the closed position illustrated, the door knob 18 may be moved in the direction of arrow 28 thus extending spring 25 and enabling the distal end of bolt 14 to engage the sleeve 22 so that rotation of the door knob 18 in a clockwise direction will screw threadably engage bolt 14 with screw threaded sleeve 22 thus clamping the two doors together against the stopping 11 and 11A. As both doors open outwardly away from one another, it is extremely difficult for an intruder to break into doors secured together in this manner as well as being secured by means of conventional latch locks or dead bolts or the like.

Figure 1A:
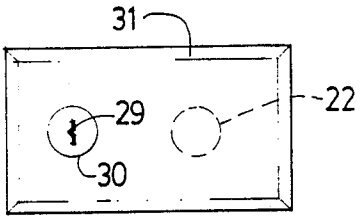
FIG. 1A shows a front view of the outside door with a modified lock set outer plate.

If desired, the element 19 may be incorporated with a conventional latch lock assembly or dead bolt assembly operated by a key (not illustrated) engageable within a key hole 29 operating lock barrel 30 in a conventional manner and held within an outer decorative plate 31 within the screw threaded sleeve 22 extending from the plate 31 to one side of the barrel 30 (see FIG. 1A).

Figure 3:
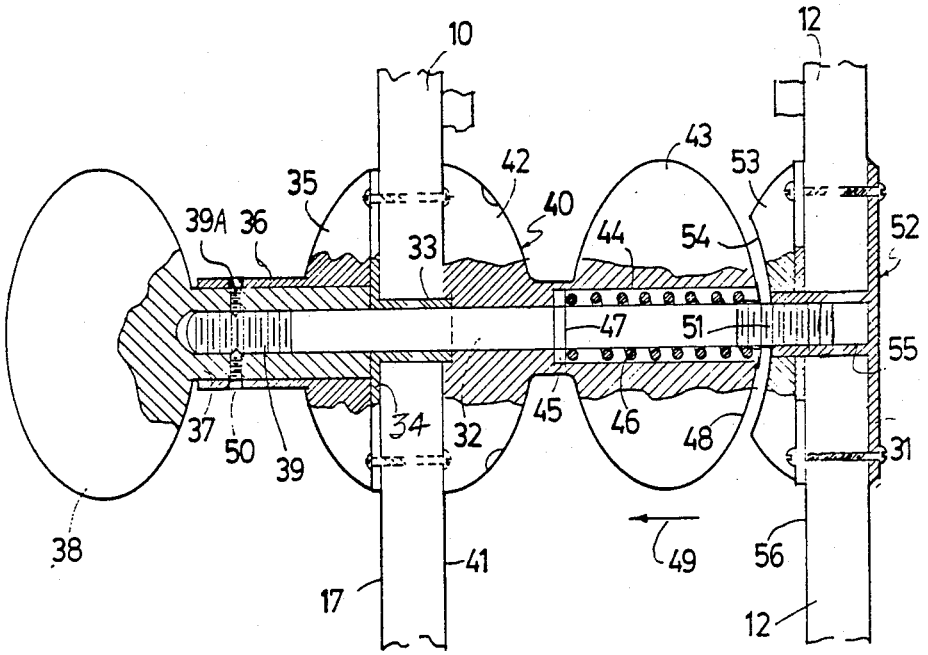
FIG. 3 is a view similar to FIG. 1 but showing a further embodiment of the invention.
Figure 4:
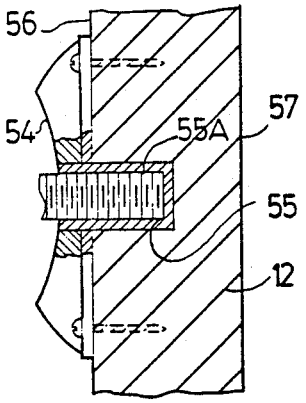
FIG. 4 shows a fragmentary vertical section of the outer door of FIG. 3 but with the invention designed for use independently of the conventional lock set.

FIGS. 3 and 4 show a further embodiment with FIG. 3 showing the element in the outer door 12 in combination with the lock (not illustrated) in a manner similar to that shown in FIG. 1A whereas FIG. 4 shows the embodiment of FIG. 3 as a separate installation.

In FIG. 3, a bolt 32 is mounted for rotation within a sleeve 33 extending through the inner door 10 and being secured thereto by means of a flange plate 34 on the inner side 17 of the inner door.

The flange plate 34 may have a convex outer surface 35 for decorative purposes, terminating in an inwardly extending sleeve 36 through which the inner end 37 of an inner door knob 38 may engage and be held by means of lock screws 39A. The end 37 of the door knob 38 is preferably internally screw threaded and screw threadably engages the external screw threaded end portion 39 of the bolt 32 thus facilitating installation.

A combination door knob assembly or rosette 40 is provided on the other surface 41 of the inner door 10 and matches the configuration of the assembled door knob 38 and flanged plate 35 on the other side. This combination door knob assembly includes the convex flanged portion 42 screw threadably secured to the outer surface 41 of the inner door, together with a further door knob 43 formed integrally therewith and having a bore 44 formed therethrough. This combination door knob assembly is secured to the portion of the bolt 32 extending from the outer surface of the inner door 41, by means of lock screws or lock nut 45. A compression spring 46 is provided within bore 44 and reacts between a cross pin (or lock nut) 47 and the inner surface of the outer convex surface 48 of the knob 43 thus normally urging the bolt 32 in the direction of arrow 49. In this connection, the lock screws 39 may be mounted in elongated slots 50 to allow sufficient movement to withdraw the distal screw threaded end 51 of the bolt, flush with or slightly within the convex surface 48 of the knob 43, when the device is not operatively connected to the outer door 12.

The element collectively designated 52, in the outer door 12 is similar to the corresponding element shown in FIG. 1 when formed in combination with a lock set similar to that described relative to FIG. 1A. The only difference is that it is desirable that the inner flange or rosette 53 is concavely curved as at 54 to match the convex curvature of the outer surface of knob 43 so that when in the closed and lock position, these two surfaces nest one within the other as shown in FIG. 3.

The sleeve 55 extending from the lock plate 31 is internally screw threaded and is aligned to receive the screw threaded end 51 of the bolt when the doors are in the closed position illustrated and the knob 38 is pushed in a direction opposite to arrow 49 thus overcoming the compression of spring 46 and allowing the end 51 of the bolt to be screw threadably engaged within the sleeve 55.

In FIG. 4, the sleeve 55A extends outwardly from the inner surface 56 of the outer door 12 and terminates spaced from the surface 57 in a manner similar to that of FIG. 2.

In both cases, the spring 46 retracts the end of the bolt flush with the knob 43 when disengaged so that it does not interfere with the normal closing of the inner and outer doors.

Figure 5:
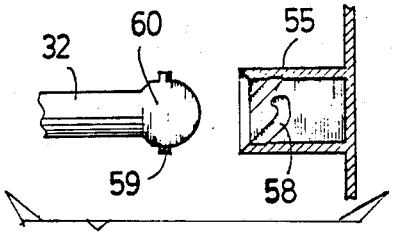
FIG. 5 is a fragmentary side elevation of an alternate method of securing the two elements together.

FIG. 5 shows an alternative method of securing the bolt or element to the sleeve 22 or 55 and consists of an angulated slot such as a cam slot 58 within the wall of sleeve 55 engageable by pins 59 extending from the end 60 of the bolt 32 thus giving a click lock type connection between the two doors which can be operated merely by a slight turn of the knob 38 or 18 rather than engaging and disengaging screw threads one with the other. The slot and pin combination may, of course, be reversed in location, if desired.

Advantages of the invention include the fact that the inside and outside doors are bolted together merely by closing both doors and pushing the inside door knob until the bolt makes contact with the element in the outside door and then turning the door knob clockwise until the doors are bolted together. To unlock the door, merely turn the knob counterclockwise until the door is unlocked. Furthermore when the door is open, a spring pushes the bolt back inside the doorknob so that it is clear of the element in the outer door.

It assists in preventing break and entry and enables the door to be unlocked in the case of fire or emergency.

Because of the clamping together of the two doors, a better weather seal is obtained and it may in fact help to straighten out some poorly fitting doors. Both doors are locked in one operation with a lock that is less expensive then a conventional lock system. Furthermore the lock will not stick or jam, a fault that is evident with many existing locks when used in wooden doors and under relatively damp conditions.

Figure 6:
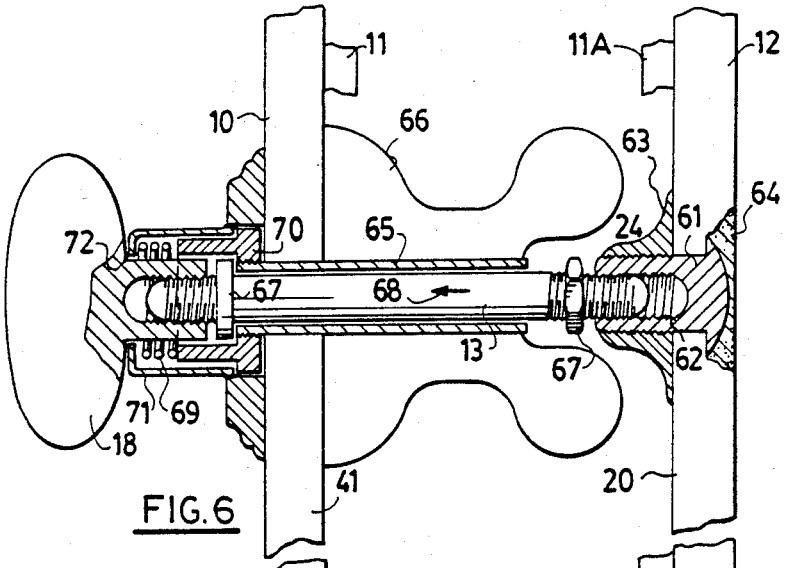
FIG. 6 is a view similar to FIG. 3 but showing an alternative embodiment.

In FIG. 6, an element 61 is secured to the outer door 12 and includes an internally screw threaded bore 62 upon the inside 20 of the outer door including a rosette 63 secured to the door. The outer end portion of the element 61 is recessed from the outside of the door and is countersunk and filled with a filler material 64.

The inner element or knob 18 is screw threadably secured to a bolt 13 which is rotatable within a fixed tube 65 extending through the inside door 10 and through the combination knob 66 secured to the inner surface 41 of the inside door. Lock nuts 67 are adjustable to permit limited endwise movement of this bolt 13 normally maintained or urged in the direction of arrow 68 by means of a return spring 69 reacting between a fixed hub 70 secured to the outer end of tube 65 and a collar 71 secured to the shank 72 of the door knob 18.

FIG. 6 shows the two doors in the closed position with the outer screw threaded end 24 of the bolt screw threadably engaging within the bore 62 of the element 61.

Rotation of the knob 18 rotates bolt 13 thus disengaging same from the element 62 and permitting the two doors to be opened with spring 69 moving bolt 13 endwise in the direction of arrow 68.

When the two doors are closed, the screw threaded end 24 is just clear of engaging the bore 62 until the knob is pushed in the opposite direction of arrow 68 against pressure of spring 69 thus enabling the end 24 to be rotatably engaged within the bore 62 thus clamping the two doors together.

Figure 7:
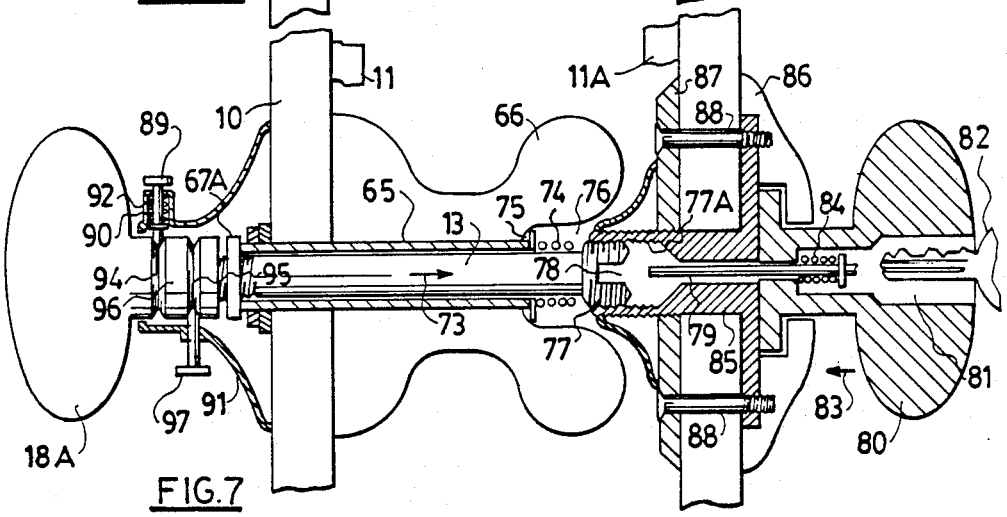
FIG. 7 shows a variation of FIG. 6 which is only operable from the inside door.

The remaining views 7 through 12 show assemblies which are key actuated. FIG. 7 includes bolt 13 rotatable through tube 65 which extends through inner door 10 and the combination knob assembly 66 on the inner side 41 thereof. Knob 18A is screw threadably engaged upon bolt 13 so that bolt 13 is rotatable by the knob and jamb or lock nut 67A controls the endwise movement of bolt 13 and knob 18A normally urged in the direction of arrow 73 by means of a spring 74 reacting between a shoulder 75 within a bore 76 on the combination of 66 and the enlarged screw threaded end 77 of the bolt 13. This enlarged screw threaded end is provided with a polygonal cross-sectioned recess 78 selectively engageable by a corresponding cross-sectioned shaft 79 as will hereinafter be described.

The outer element 80 takes the form of a doorknob having a conventional tumbler lock 81 therein operated by key 82. When the tumbler lock is unlocked by key 82, it enables the key 82 to be moved in direction of arrow 83 at the same time moving the shaft 79 into engagement with the recess 78 so that rotation of the knob will allow the bolt 13 to be rotated in either direction.

It will be noted that spring 84 normally urges the knob and the shaft 79 to the outermost position disengaged from recess 78.

Although the recess 78 and shaft 79 can be of any matching configuration, it is convenient that an Allan wrench-type configuration be used.

FIG. 7 shows the two doors 10 and 12 in the closed and locked position. By rotating key 82 within tumbler lock 81, the key 82 may be moved inwardly so that shaft 79 engages recess 78 thus enabling rotation of the knob to disengage bolt 13 from the inner door as the screw threaded end 77 is disengaged from the screw threaded recess 77A within the cylinder 85 extending through the outer door and secured in place by means of rosette 86, plate 87 and screws 88.

As soon as the bolt 13 is disengaged from the inner door, the two doors can be separated and opened in the usual way.

Spring 74 normally maintains the bolt end 77 in the extended position but this is controlled by means of a set screw or push pin 89 mounted through boss 90 on the rosette 91 of the inner door 10. This pin is normally maintained in the innermost position by means of compression spring 92 so that the inner end 93 engages one of two annular grooves 94 and 95 formed on the shank 96 of knob 18A. This enables the doorknob and hence the bolt to be set in either position and to be removed readily from one position or the other.

A locking screw 97 may also be used to prevent any rotation from occurring to knobs 18A, 80 and shaft 13. This also extends through the rosette and into an aperture (not illustrated) within shank 96 of knob 18A.

Figure 8:
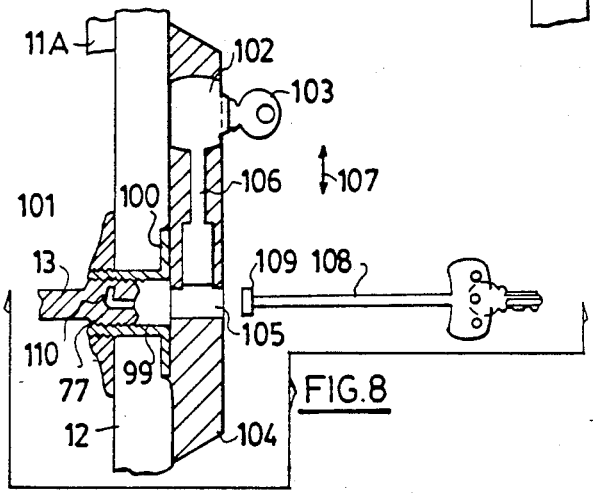
FIG. 8 is a fragmentary side section of a further embodiment of an outside lock system.

FIG. 8 shows an alternative locking arrangement for the outer door 12 which includes sleeve 99 extending therethrough and having an outer flange 100 engageable with the outer side of the outer door 12. A rosette 101 screw threadably engages over the inner end of the sleeve and clamps it firmly in position. The outer end 77 of bolt 13 screw threadably engages within the inner end of sleeve 99 thus holding the two doors in the closed and clamped position.

A tumbler lock or the equivalent 102 is secured to the outer side of the door above the sleeve 99 and is actuated by key 103. This is mounted in a plate 104 secured to the outside of the door which includes an opening 105 through the plate and in alignment with the interior of sleeve 99. The lock 102 actuates a lever or plate 106 moving same in the direction of double-headed arrow 107. When in the position shown in FIG. 8, the aperture 105 is clear because the plate is in the raised position. However when the lock 102 is moved to the locked position by means of key 103 then the plate moves downwardly and covers the aperture 105.

A bolt engaging key 108 is engageable through the aperture 105 and into the bore of the sleeve 99 so that a cross pin 109 on the end of the bolt key 108 may engage within the angulated slot 110 in the end of the portion 77 of the bolt 13 thus enabling this bolt to be rotated in either direction thus engaging or disengaging same from the screw threaded interior of sleeve 99.

Figure 9:
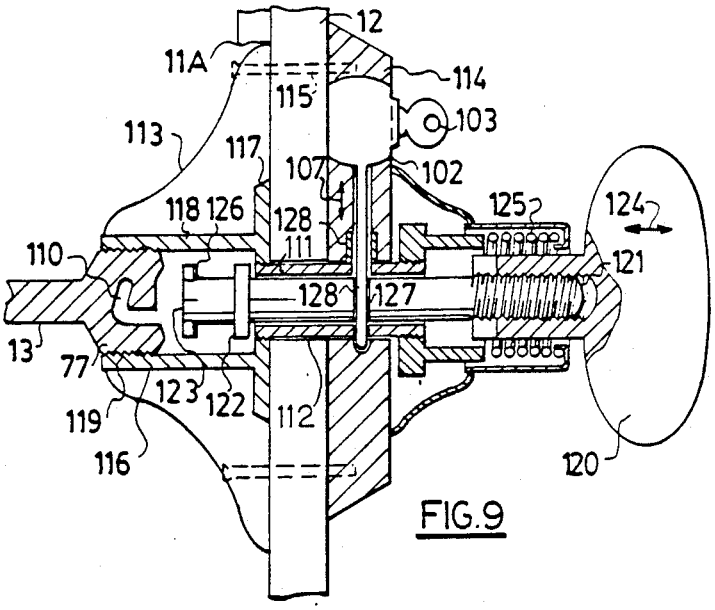
FIG. 9 is similar to FIG. 8 but showing a further key construction and operation.

FIG. 9 is similar to FIG. 8 but shows an alternative arrangement in which a sleeve 111 is secured within a bore 112 through the outer door 12.

A rosette 113 is secured to the inner side of the door 12 and to an outer plate 114 by means of screw bolts 115. A flanged sleeve 116 includes flange 117 which is recessed within the rosette 113 with the sleeve portion 118 extending through the rosette and being screw threaded internally as at 119 to be selectively engageable by means of the screw threaded end 77 of the bolt 13 as hereinbefore described.

The outer knob or element 120 includes a shaft 121 which extends through the rosette and plate 114, through the sleeve 111 and into the bore of the sleeve portion 118 of sleeve 116. A flange 122 is formed on the inner end of shaft 121 spaced inwardly from the inner end 123 and is positioned to allow limited endwise movement of the knob and shaft 120 and 121, in the direction of arrow 124 and is normally urged outwardly by means of compression spring 125 reacting between the rosette 114 and the knob 120.

A cross pin 126 extends transversely of the inner end 123 of shaft 121 and is engageable within the angulated slot 11 formed within the end portion 77 of the bolt 13 as hereinbefore described.

A drilling 127 is formed through shaft 121 in alignment with a bore 128 within the rosette when the knob is urged outwardly by spring 125 to the position shown in FIG. 9, said outward movement being limited by flange 122 engaging the inner end of sleeve 111.

A tumbler type lock or the like 102 is actuated by key 103 and moves a locking pin in the direction of doubled headed arrow 107. When in the position shown in FIG. 9, the lock is in the locked position so that pin 128 is engaged through the drilling 127 thus preventing any rotation or inward movement of knob 120 and hence shaft 121.

However when the key is rotated to unlock the lock 102, pin 128 is withdrawn from the drilling 127 thus enabling the shaft to be pushed inwardly and the cross pin 126 to be engaged within the slots 110 thus enabling the bolt 13 to be rotated in either direction thus engaging or disengaging same from the outer door.

Figure 11:
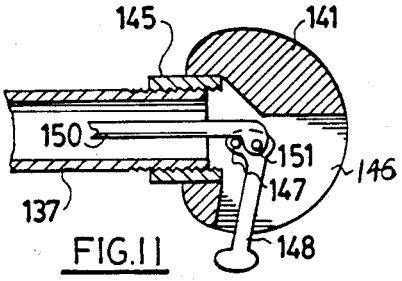
FIG. 11 shows a fragmentary side elevation of the outer portion of FIG. 10 but in the locked position.
Figure 12:
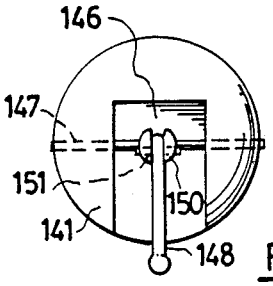
FIG. 12 is an end view of the actuating knob assembly on the right hand side of FIG. 10.
Figure 10:
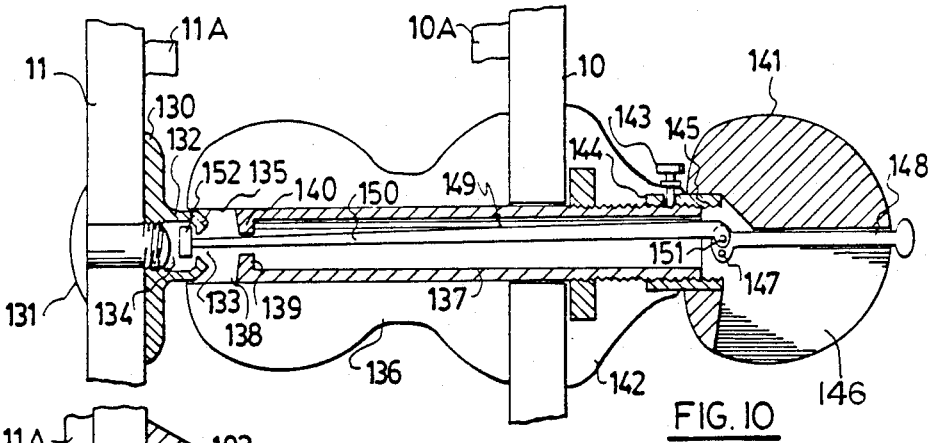
FIG. 10 is a view similar to FIG. 3 but showing a still further embodiment in the unlocked position.

FIGS. 10, 11 and 12 show a further embodiment actuated from the inside door.

A rosette 130 is secured against the inner face of the outside door 11 by means of a blind bolt 131 passing therethrough, said rosette having an inwardly extending boss 132 which is slotted transversely as at 133 to communicate with the interior bore 134 thereof and jaws 135 are formed on either side of the slot 133 as clearly shown.

A combination knob assembly 136 is secured to the outer surface of the inner door 10 and a sleeve or tube 137 extends through an aperture within the inside door and through an aperture or bore 138 in the combination knob 136.

The outer end 139 of the sleeve or tube 137 is closed but is transversely slotted as at 140.

A knob 141 is secured for rotation within a rosette 142 which in turn is secured to the inner surface of the inside door surrounding the bore extending therethrough and a pin 143 mounted in the rosette and engaging a blind slot 144 within the sleeve 145 of the knob limits the rotation or movement thereof.

The knob is provided with a arcuate slot 146 and a cross pin 147 spans this slot and acts as a pivot for an actuating lever 148 forming part of a lever assembly collectively designated 149. It includes link 150 pivotally secured by means of pivot pin 151 to the inner end of the actuating lever 148 spaced above its pivot 147. On the outer end of link 150 there is formed a cross pin 152 which, when aligned with slot 140 within the end 139 of the sleeve 137, may pass therethrough and through slot 133 within the jaws 135.

When the actuating lever 148 is in the position shown in FIG. 10, the cross pin 152 has been engaged between jaws 135 and rotated approximately 90° by rotation of knob 141.

Movement of the actuating lever in the downward position, to the position shown in FIG. 11, pulls the cross pin 152 into engagement with the jaws 135 and firmly locks the two doors together, it being noted that actuating lever 148 has passed over center to the locked position clearly shown in FIG. 11.

When the lever is moved to the position shown in FIG. 10, the pin is released from jaws 135 and can be rotated through 90° by rotation of knob 141 thus allowing same to be withdrawn by pulling the inside door away from the outside door. Hook elements may, of course, be substituted for cross pin 152 and jaws 135.

All of the above mentioned embodiments utilize mechanical actions for opening and closing the two doors and actuating the clamping assemblies.

However it will of course be appreciated that electronic actuators can easily be adapted for use with the above assemblies. These can either take the form of a door opener similar to a garage door opener or, a coding pad whereupon the doors will only be actuated if the correct code is punched in. As such actuators are well known, it is not believed necessary to describe same further.

It will also be noted that the assemblies are designed specifically for use with outer and inner doors of residences and the like. However it will of course be appreciated that they are readily adapted for use with any forms of inner or outer covers, casement windows or the like and in the claims, these are all referred to generically by the term "panels". Furthermore, the assemblies may be used to improve the weather sealing characteristics of such "panels" either with or without the security measures.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A security assembly for double panel installations which include an inner panel and an outer panel situated in spaced and parallel relationship within a panel frame, when in the closed position and opening in opposite directions when in the open position; said assembly comprising in combination a cooperating element in the outer panel, an element in the inner panel in engaging alignment with said cooperating element of said outer panel when said panels are in the closed position, and means on an inside end of the element in said inner panel for selectively and lockably engaging said element of said inner panel with said cooperating element of said outer panel thereby securing said panels together in a unitary relationship one with the other, said cooperating element on said outer panel including retainer means on the inner side thereof, said element on said inner panel including tube means mounted on said inner panel substantially perpendicular thereto, a knob being mounted on said tube means for partial rotation of the knob, a lever assembly operatively connected to said knob and extending through said tube means, and means on an outer end of said lever assembly selectively engageable and disengageable with said retainer means, said lever assembly including a link freely extending through said tube, and an actuating means operatively engaged with the knob and an inner end of the link to transmit rotary motion of the knob to the link as the knob is rotated between a retainer means engaging and a retainer means disengaging position, the actuating means being operatively engaged with the link to shift the link end-wise in the tube in response to movement of the actuating means relative to the knob.

2. The assembly according to claim 1 in which said means on the outer end of said lever assembly includes a cross pin secured to said outer end and extending perpendicularly therefrom, said retainer means including an elongated transverse slot through which said cross pin engages when aligned therewith and jaws inside said slot engageable by said cross pin when said cross pin is situated at right angles to said slot after being engaged therethrough.

3. The assembly according to claim 1 in which the actuating means comprise an actuating member moveable between a link-releasing position in which the link is shifted outwardly in the tube means and a link-engaging position in which the link is shifted inwardly in the tube means.

4. The assembly according to claim 3 in which said actuating member is pivotally secured to the inner end of the link, and including a radial slot in said knob, said actuating member being moveable through approximately 90° in said slot thereby shifting said link end-wise in said tube means.

5. The assembly according to claim 4 in which said means on the outer end of said lever assembly includes a cross pin secured to said outer end and extending perpendicularly therefrom, said retainer means including an elongated transverse slot through which said cross pin engages when aligned therewith and jaws inside said slot engageable by said cross pin when said cross pin is situated at right angles to said slot after being engaged therethrough.

6. The assembly according to claim 5 in which said actuating member passes over center when moved to the retainer means engaging position.

7. The assembly according to claim 6 in which said actuating member is mounted for arcuate movement in said slot in said knob, a pivot pin spanning said slot, said actuating member being pivotally connected adjacent the inner end thereof to said pivot pin, said link being pivotally connected to the actuating member adjacent said one end of said actuating member and off-set from said pivot pin.

8. The assembly according to claim 5 in which said actuating member is mounted for arcuate movement in said slot in said knob, a pivot pin spanning said slot, said actuating member being pivotally connected adjacent one end thereof to said pivot pin, said link being pivotally connected to said actuating member adjacent said one end of said actuating member and off-set from said pivot pin.

9. The assembly according to claim 8 wherein the link passes over center with respect to the pivot pin when the actuating member is moved to the retainer means engaging position.

10. The assembly according to claim 4 in which said actuating member passes over center when moved to the retainer means engaging position.

11. The assembly according to claim 10 in which said actuating member is mounted for arcuate movement in said slot in said knob, a pivot pin spanning said slot, said actuating member being pivotally connected adjacent one end thereof to said pivot pin, said link being pivotally connected to said actuating member adjacent said one end of said actuating member and off-set from said pivot pin.

12. The assembly according to claim 4 in which said actuating member is mounted for arcuate movement in said slot in said knob, a pivot pin spanning said slot, said actuating member being pivotally connected adjacent one end thereof to said pivot pin, said link being pivotally connected to said actuating member adjacent said one end of said actuating member and off-set from said pivot pin.

13. The assembly according to claim 12 wherein the link passes over center with respect to the pivot pin, when the actuating member is moved to the retainer means engaging position.

* * * * *

UNITED STATES PATENT AND TRADEMARK OFFICE

CERTIFICATE OF CORRECTION

PATENT NO. : 4,891,907

DATED : January 9, 1990

INVENTOR(S) : MYCHAIL RAPAWY

It is certified that error appears in the above-identified patent and that said Letters Patent is hereby corrected as shown below:

On the title page, under item [19] and in item [76], "Rapaway" should read --Rapawy--.

Signed and Sealed this

First Day of October, 1991

*Attest:*

*Attesting Officer*

HARRY F. MANBECK, JR.

*Commissioner of Patents and Trademarks*